United States Patent [19]

Hill

[11] Patent Number: 4,703,699

[45] **Date of Patent: * Nov. 3, 1987**

[54] LIGHTWEIGHT CONTAINER CAR

[75] Inventor: Charles C. Hill, Del Mar, Calif.

[73] Assignee: Gunderson, Inc., Portland, Oreg.

[ * ] Notice: The portion of the term of this patent subsequent to Jul. 15, 2003 has been disclaimed.

[21] Appl. No.: 822,754

[22] Filed: Jan. 27, 1986

Related U.S. Application Data

[63] Continuation-in-part of Ser. No. 704,435, Feb. 25, 1985, Pat. No. 4,599,949.

[51] Int. Cl.[4] ..... B61D 3/20; B61D 17/08

[52] U.S. Cl. ..... 105/355; 105/418; 296/205

[58] Field of Search ..... 105/200, 226, 228, 238 R, 105/355, 413, 414, 418–420, 238.1; 296/203–205, 209; 280/781, 796–798; 52/731

[56] References Cited

U.S. PATENT DOCUMENTS

| | | | |
|---|---|---|---|
| 2,194,356 | 3/1940 | Eklund | 280/797 |
| 2,327,585 | 8/1943 | Ulrich | 280/797 X |
| 2,504,112 | 4/1950 | Dean et al. | 105/414 |
| 3,520,256 | 7/1970 | Gutridge | 410/52 |
| 3,659,724 | 5/1972 | Miller et al. | 105/418 X |
| 4,064,947 | 12/1977 | Cole | 52/731 X |
| 4,091,742 | 5/1978 | Cordani | 105/418 X |

FOREIGN PATENT DOCUMENTS

| | | | |
|---|---|---|---|
| 629980 | 12/1961 | Italy | 52/731 |

OTHER PUBLICATIONS

Bromma Spreader 20'–40', EH6.

*Primary Examiner*—Randolph A. Reese

*Attorney, Agent, or Firm*—Chernoff, Vilhauer, McClung & Stenzel

[57] ABSTRACT

Improvements in the body of a lightweight railway car are disclosed with one improved portion being a side sill formed from a metal plate having a plurality of short tubes welded thereto and projecting outwardly therefrom. A channel is welded to the plate and has a plurality of holes formed therein which are aligned with the tubes, with the metal removed to form the holes being substantially equal in weight to that of the tubes. The tubes are welded to the channel near the periphery of the holes. The side sills cooperate with body bolsters and container-engaging feet for handling a double tier of a variety of different sizes of containers.

23 Claims, 8 Drawing Figures

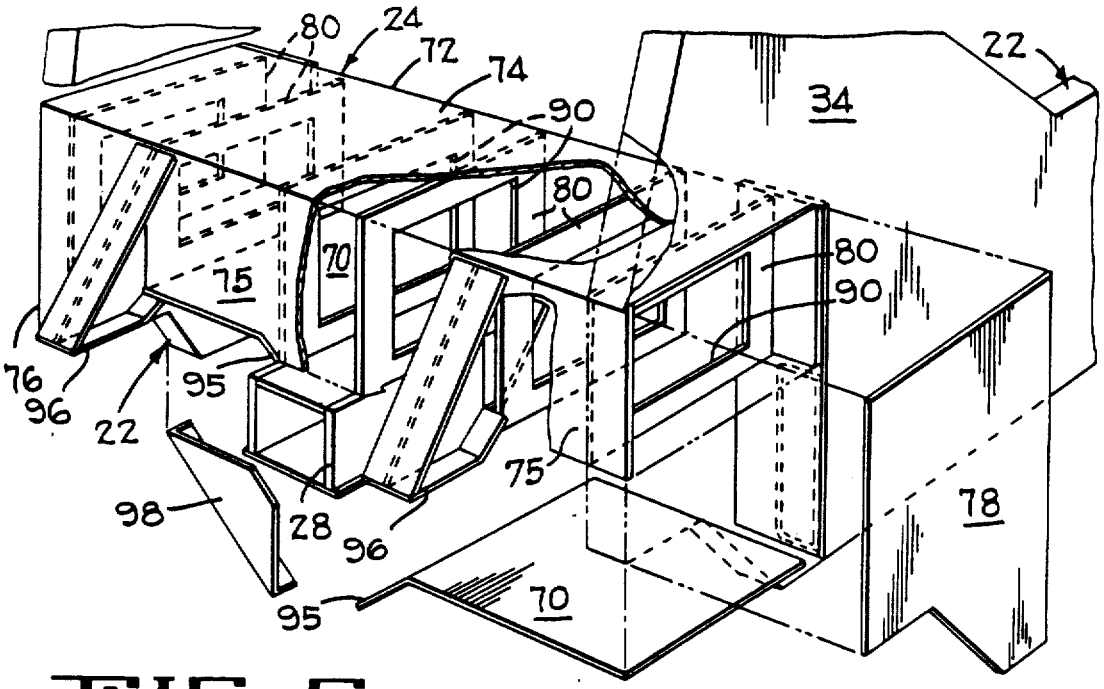
FIG_6
FIG_8
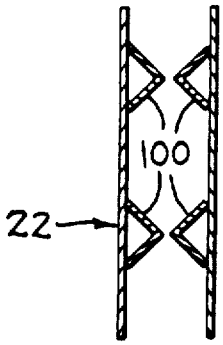
FIG_7
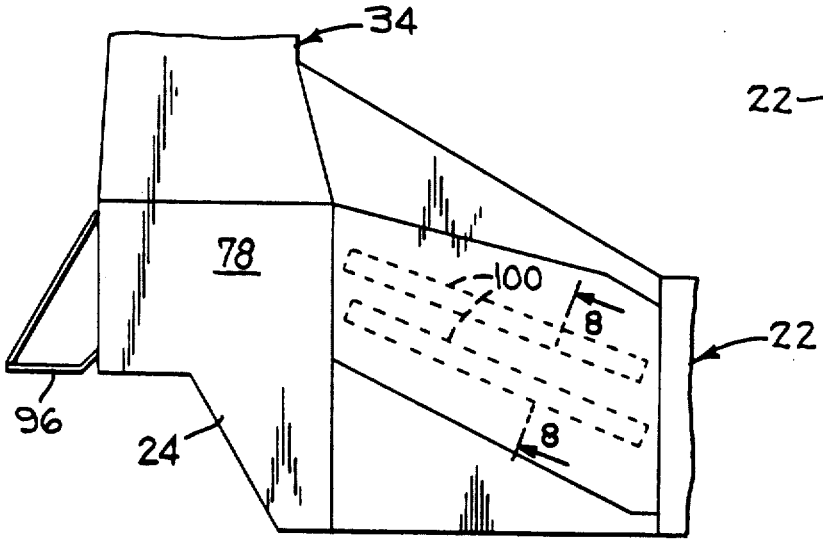

LIGHTWEIGHT CONTAINER CAR

CROSS-REFERENCE TO RELATED APPLICATIONS

This is a continuation-in-part of a pending U.S. patent application Ser. No. 704,435, filed Feb. 25, 1985, now U.S. Pat. No. 4,599,949, issued July 15, 1986.

The present invention is also related to the invention disclosed in Kaleta U.S. patent application Ser. No. 640,733 which was filed Aug. 14, 1984 and is entitled Stack Supporting Container Car, and which is now U.S. Pat. No. 4,624,188, issued Nov. 25, 1986. The Kaleta application is assigned to the assignee of the present invention and is incorporated herein by reference.

BACKGROUND AND SUMMARY OF THE INVENTION

Field of the Invention

The present invention is related to lightweight railway cars and more particularly relates to such cars having side sills and body bolsters which are light in weight, with the side sills reinforced to minimize local buckling.

Because of the overall size limitations within which a loaded railway car must fit, and because of the railway clearances and the configuration of conventional side-loading equipment available for loading containers onto railway cars, only a limited amount of volume is available within which the side sill structures of a container-carrying railway car may be constructed. Nevertheless, the side sills must have sufficient strength to support vertical bending loads applied when the car is laden, and to resist torsional and axial stresses resulting from the loads applied during travel of a laden car. Nevertheless, the weight of the side sill structures must be kept to a minimum in order not to limit the revenue-producing load which may be carried on such a car equipped with conventional trucks. While a thin-walled box beam structure can provide, theoretically, the required strength to support the expected vertical loading, the compressive axial loading to which the side sills of a railway car may be subjected, as a result of the normal operation of a railroad train, is likely to result in localized buckling of the thin metal of such a box beam structure, ultimately resulting in complete failure of the side sills, unless reinforcement is provided. Conventional internal web reinforcing structure for thin-walled box beam structures expected to be subjected to bending, axial compression, and torsional stresses is undesirably heavy and costly to assemble for use in such railway cars.

Since cargo containers are placed between the side sills, structural interconnection between the top edges of the side sills is prevented, and the side sills must, therefore, have sufficient torsional rigidity to prevent failure when such a container-carrying railway car is laden, particularly if two containers, such as 20-foot containers, are carried on such a car end-to-end, applying vertical loading midway between the supporting trucks of the car. The side sills of such a car must, then, have ample strength to resist torsion as well as vertical loading without being excessively heavy.

In accordance with the present invention, lightweight but strong side sills are each constructed of a thin metal outer plate to which is welded a thin inner channel that is provided with a plurality of spaced apertures along its length. A plurality of short transversely extending strengthening rings or tubes are welded to the outer plate and to the peripheries of the apertures in the channel to provide a rigid box beam side sill in which localized warping and buckling during normal operation is prevented by the interconnection of the opposite vertical faces of the side sill at the locations of the tubes. The weight of the thin-walled side sills is significantly less than that of conventional closed box beam construction using sheet material thick enough to accept the same loading without reinforcement. Additionally, the weight of material removed from the channel member to form the openings compensates at least partially for the weight of the tubes, and may be greater than the weight of the tubes, thus further reducing the overall weight of the car. Furthermore, the openings provide access to the interior of the side sills to enable the tubes to be welded to the channel and plate members of the side sill.

The side sills are rigidly secured to body bolsters which are fabricated as box beams of thin metal plate to further reduce the weight of the car. The car is provided with container supporting feet secured to the lower portion of the side sills for supporting either two 20-foot or one 40-foot long container in a lower tier; and either a 40-foot or 45-foot container in an upper tier. The car may support a stack of containers having a total height of about 19 feet, and a width of either about 8 feet or 8½ feet. It is to be understood that the car can be appropriately designed to handle other container lengths such as 45- and 48-foot-long containers in the lower tier and appropriate combinations of containers on the upper tier.

BRIEF DESCRIPTION OF THE DRAWINGS

FIG. 6 is a partially exploded perspective of one of the body bolsters shown connected to the side sills.

FIG. 7 is a fragment of one end of a side sill illustrating the side sill connected to a body bolster.

FIG. 8 is a section taken along lines 8—8 of FIG. 7 illustrating v-shaped stiffening members.

DESCRIPTION OF THE PREFERRED EMBODIMENT

Figure 1:
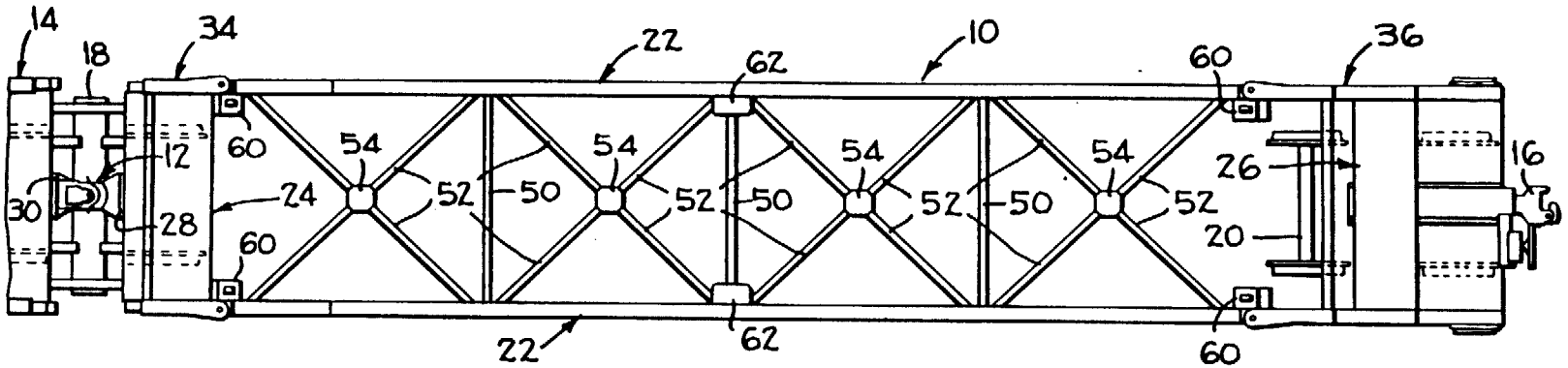
FIG. 1 is a plan of one end car having a standard coupler on one end and an articulating coupler on the other end shown coupled to a fragment of an intermediate car.

The lightweight container car 10 (FIGS. 1-3) of the present invention is similar to that disclosed in the aforementioned Kaleta application. Accordingly, components of the car 10 which are similar to those of the Kaleta car will not be described in detail and if a more detailed description is desired of these components, reference may be had to the cross-referenced Kaleta application.

In general, a plurality of cars (or car units), preferably five car units, are connected together by articulating joints 12 that pivotally connect intermediate cars 14

(only one being shown) to other intermediate cars and to two end cars 10 (only one being shown) which have standard railway couplers 16 thereon for connection to standard railway cars or to a railway engine (not shown). It will be noted that the adjacent ends of each pair of cars that are coupled together by an articulating joint 12 are both pivotally supported on a common four-wheel truck such as truck 18; while the other end of each end car 10 (only one being shown) is supported by only one truck 20.

Each end car 10 includes a pair of side sills 22 which are rigidly connected to body bolsters 24, 26. The body bolster 24 is connected to a stub center sill 28 rigidly secured to one-half of the associated articulating joint 12 while the other half of the articulating joint 12 is rigidly secured to the stub center sill 30 of the next adjacent intermediate car, such as car 14. Similarly, the body bolster 26 is rigidly connected to a stub center sill 32 which is, in turn, rigidly connected to the coupler 16. The articulating joint 12 is pivotally connected to the associated trucks 18 by conventional means (not shown). The body bolster 26 is likewise pivotally connected to the truck 20 by conventional means (not shown).

End bulkheads 34, 36 are welded to the adjacent ends of the side sills 22 and to the adjacent body bolsters 24, 26, respectively. It will be noted that the end bulkhead 36 is slightly longer than the bulkhead 34 to accommodate the slightly longer side sills 22 that are required on the end cars, such as car 10, due to the need of the four-wheel truck 20 and standard coupling 16 for connection to other standard railway cars. It will be understood that all intermediate cars have short bulkheads 34 on both ends of the side sills of the associated cars, and that the side sills of intermediate cars are formed with both ends the same as the bulkhead 34 of car 10.

Figure 4:
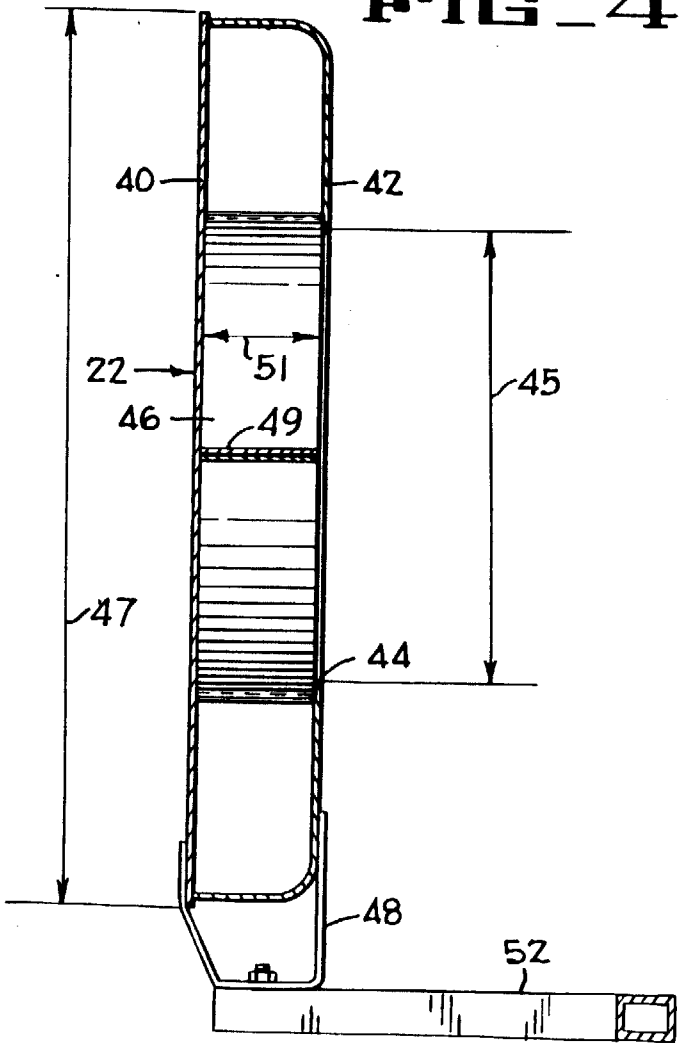
FIG. 4 is a transverse section taken along lines 4—4 of FIG. 2 through one of the side sills.
Figure 5:
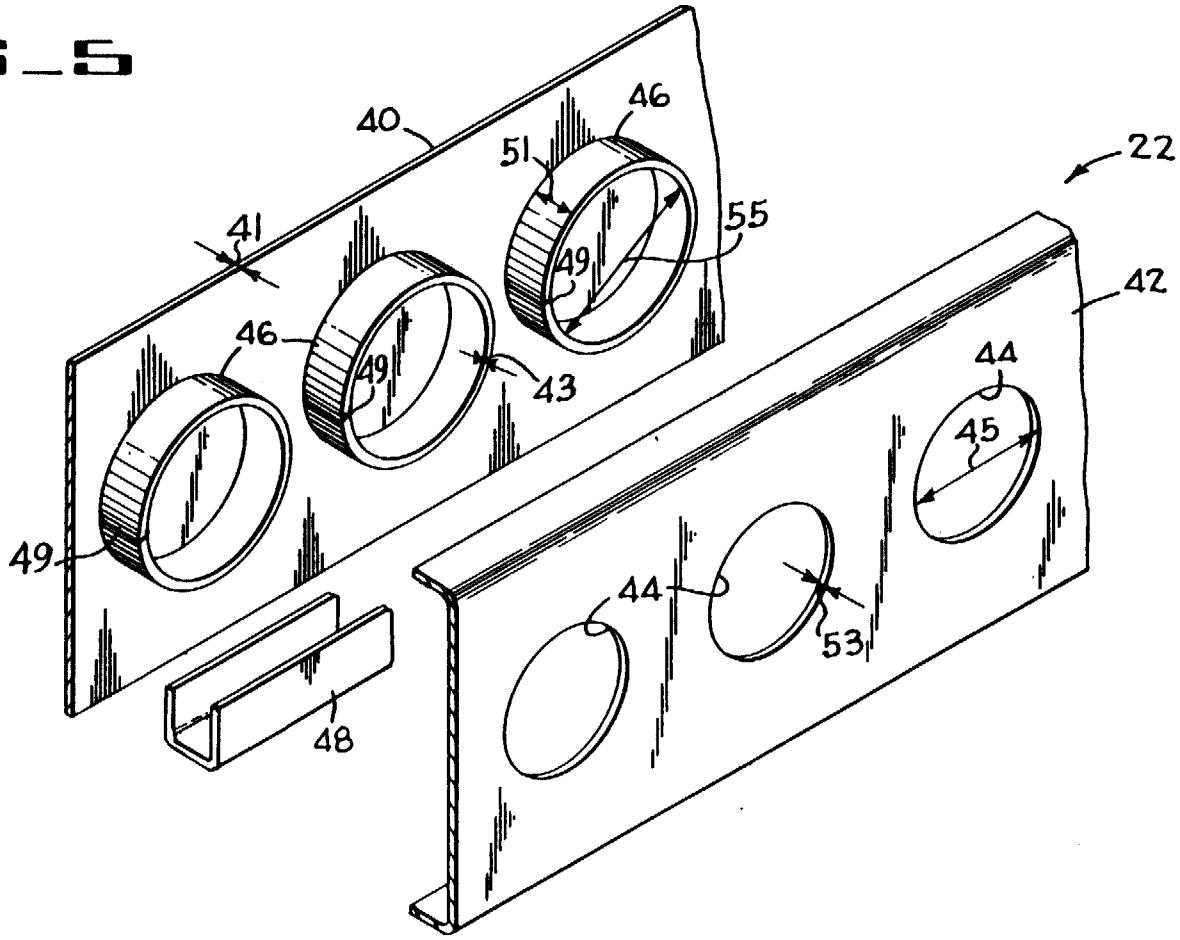
FIG. 5 is an exploded perspective of a fragment of one of the side sills illustrating the tubes welded to the outer side plate and an inner channel portion with evenly-spaced holes therein.

An important feature of the invention is that each side sill 22 (FIGS. 2, 4 and 5) comprises a generally flat outer plate 40 and a channel 42 on an inner side of the plate 40. The channel 42 is preferably of flat sheet metal bent into channel shape. The channel 42 has a plurality of evenly-spaced large holes 44 cut therein. In a preferred embodiment, twelve holes 44, each having a diameter 45 of about 21⅝ inches and thus an area of about 367 square inches, are spaced 31 inches apart from one another, center-to-center. In a preferred sequence of construction the short cylindrical tubes 46 are first welded to the inside of the channel 42, in positions aligned concentrically with the holes 44. Thereafter, the channel 42 is welded to the plate 40, and the other ends of the tubes 46 are welded to the plate 40 as best shown in FIG. 4. This sequence of assembly gives convenient access to the interior of the tubes 46 for the welding operation, as the plate 40 is usually not provided with openings corresponding to the holes 44, since a continuous flat surface is usually desirable on the outside of the side sills 22. A number of channel members 48 are then welded to the lower portion of the side sill 22. The outer plate 40 preferably has a thickness 41 of about ¼ inch, and the channel 42 preferably has a thickness 53 of about 3/16 inch, for a car 10 or 14 intended to carry a single 40-foot long container between the side sills 22. An exemplary side sill 22 of this design has a depth 47, exclusive of the channel 48, of about 42¾ inches, and a width of about 6 inches.

The cylindrical tubes 46, in a preferred embodiment of the invention, are constructed by rolling rectangular pieces of metal having a thickness 43 of about 3/16 inch into a circular ring shape having a diameter 55 of about 22 inches, the butt ends being welded together as at 49 to complete the tube. The weld preferably is located at midheight of the tube when it is installed as a part of the side sill 22. The length 51 of the cylindrical tubes 46 is about 6 inches, less the combined thicknesses of the plate 40 and channel 42. The surface area of the wall of each of the tubes 46 is thus about 384 square inches in the embodiment described immediately above, and is thus only slightly greater than the area of the material removed from the channel 42. Accordingly, each side sill is of reinforced, thin-walled box beam construction and is lighter than the side sills of assignee's aforementioned Kaleta application, while it still has anti-buckling strength equal to or greater than the side sills of the type disclosed in the Kaleta application. The material of the tubes 46 also acts to compensate for the material removed in providing the holes 44, insofar as the moment of inertia of the side sill 22 is concerned.

It will be appreciated that when two shorter containers, rather than a single container, are to be carried by the car 10 or 14, the side sills 22 must be strong enough to support vertical loading applied at midspan of the side sills 22. Consequently, in such a car, the plate 40 may be of ⅜ inch thick plate steel and the channel may be of 5/16 inch thick steel, while the tubes 46 are, nevertheless, of 3/16 inch thick material. In this case, the weight of the material removed from the channels 42 to form the open holes 44 is greater than the weight of the tubes interconnecting the plate 40 and the channel 42, so that the thin-walled side sills 22 of the invention acquire the necessary increased strength to support a pair of shorter containers with only a minimum increase of their weight beyond that of side sills 22 of a car 14, designed to carry only a single long container.

It will also be appreciated that, while it may be easiest to make the holes 44 and tubes 46 of a circular shape, the shape need not be circular. The critical feature of the invention is the provision of an adequate number of the connecting tubes 46 to prevent local buckling movement of the relatively thin plate metal material of which the channel 42 and plate 40 are constructed, so that the side sill 22 consequently has a high load-hearing strength and sufficient torsional ridigity while still being relatively light in weight. Similarly, it is not critical that all the holes 44 be of equal size, be equally spaced, or be located in a single straight line for the benefits of the invention to be gained.

Figure 2:
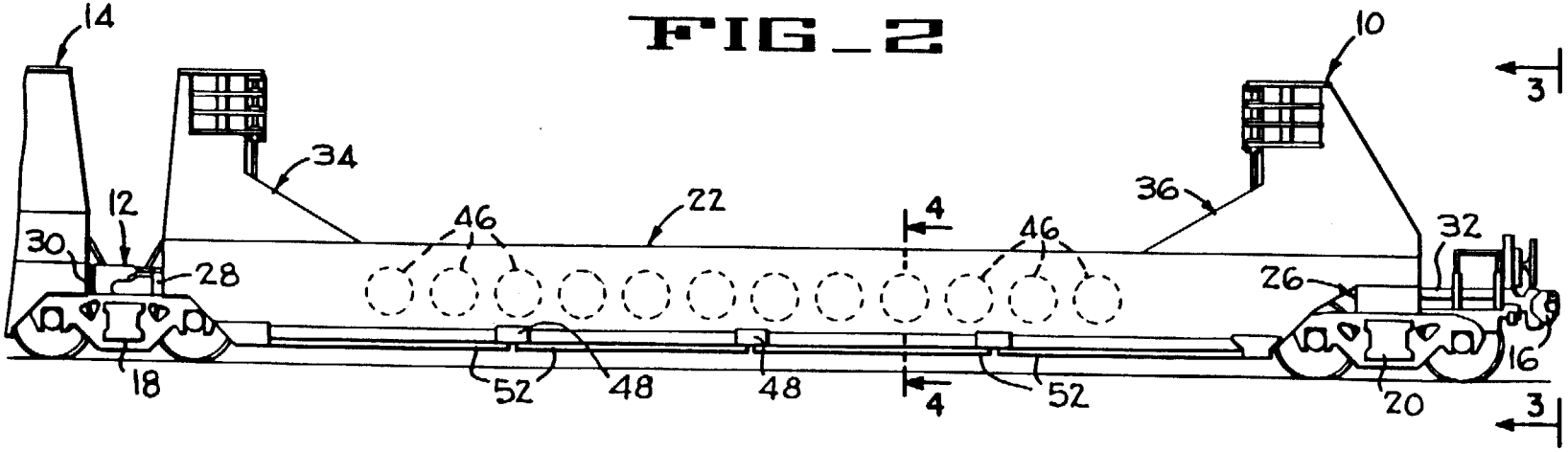
FIG. 2 is a side elevation of FIG. 1.
Figure 3:
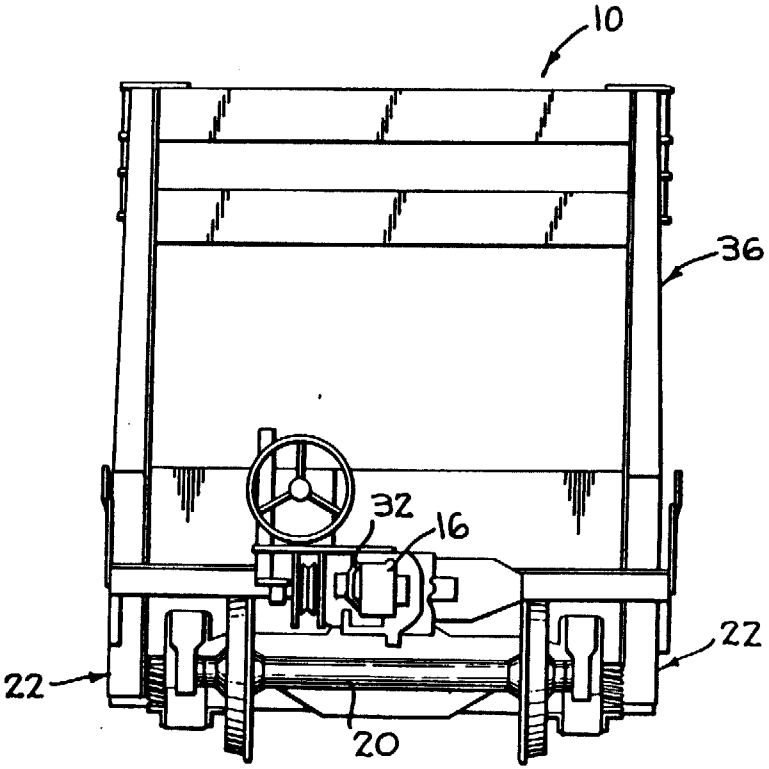
FIG. 3 is an end view of the car looking in the direction of arrows 3—13 of FIG. 2.

As best shown in FIGS. 1 and 2, the lower portions of the two side sills 22 are connected to each other by transverse beams 50 and cross beams 52. The beams 50 and 52 are attached to the channel members 48, and intermediate portions of the beams 52 are welded to centered pads 54 thereby strengthening the side sills' resistance to lateral deflection and assisting them in resisting buckling.

As illustrated in FIG. 1, four container-supporting feet 60 are rigidly secured to the side sills 22 and provide support for the corners of a 40-foot long by 8-foot (or 8½ foot ) wide container. The supporting surfaces of the feet are at an elevation slightly above the transverse beams 50 and cross beams 52. The container-supporting feet 60 are similar to those of the Kaleta application. If additional details concerning the container-supporting feet are desired, reference may be had to the Kaleta application. In addition to the corner supporting feet 60, a pair of central container supporting feet 62 are rigidly secured to the side sills 22 for supporting short containers such as two 20-foot long containers.

As best shown in FIG. 6, each body bolster 24 comprises a pair of transversely extending lower walls 70, an inner wall 72, a top wall 74, an outer wall 75, a pair of side walls 76, 78 which extend longitudinally of the railway car, and a plurality of strengthening baffles 80 having large openings 90 therein for reducing the weight of the body bolster. All of the above parts are welded together as shown in FIG. 6. These components are also welded to a stub-center sill 28 (or 30) and to bottom plates 70 having downwardly angled inner portions 95, which bottom plates 70 are welded to associated stub-center sills 28 or 30 and to side sills 22. A pair of gusseted V-shaped reinforcing members 96 are welded in alignment with each second-from-the-end baffle 80 and serve as guide means for well known side bearings of the general type disclosed in the Kaleta application. Also, a pair of angle brackets 98 (only one being shown) are welded between the associated stub-center sills 28 (or 30) and the associated bottom plate 70 to minimize bending of the body bolster 24 relative to the stub-center sill 28. The body bolster 26 at the outer end of the car 10 is basically similar in structure to the body bolsters 24, although it includes no side bearing supports 96 and includes other minor differences because of the different location of the pivot axis of the truck 20 with respect to the body bolster 26.

FIGS. 7 and 8 illustrate angle stiffening members 100 for stiffening the side sills 22 adjacent their point of connection to the associated body bolsters 24 (or 26).

It will be appreciated that the car 10 defined above cannot have a center sill because the lower surface of the container must be positioned close to the tracks below the level of a center sill. The width of the space available for a car side sill is limited by the container width, either 8 feet or 8½ feet, thus defining the inner dimension of the side sills while the outer dimension is determined by the requisite clearance line of the car. The maximum side sill height is determined by conventional side loading equipment for loading the container onto the car and sufficient clearance beneath the side sills 22 must also be provided. All of these above-mentioned factors serve to produce a very small envelope into which a side sill must fit; yet it must be of adequate strength. To gain strength to resist vertical bending loads, the side sills are made as deep as possible; and to resist localized warping and buckling, a closed section is most efficient. As a closed section, for a decrease in weight the thickness of its members must decrease; and as the thickness decreases local warping of the thin members becomes a problem.

Within the above parameters applicant has determined that the use of stiffening rings or tubes 46 most effectively prevents local warping and also contributes to section strength to resist bending and torsion. Even though holes are introduced in the web material of the channel member, the tubes added in this area put back more strength into the side sill member than would be present if the material had not been removed to provide the holes 44. The big advantage of using the rings or tubes 46 is that the tubes allow the use of their material to build a deep, strong side sill with vertical load capabilities, which is able to resist local warping and buckling, and which has a large torsional rigidity.

Torsional rigidity is important, as the opposite side sills are connected to one another only by the truss-type framework located at the bottom of each side sill. The tops of the side sills 22 must therefore be self-supporting against lateral and torsional strain. The side sills must therefore be rigid enough to be self-supporting against torsional stress when the car is fully loaded.

The use of the thin-walled side sills 22 and the lightweight but strong body bolsters 24, 26 of the invention provides a savings of more than 15 percent in the weight of a container-carrying car 10 or 14 designed to give the same gross weight of the fully-laden car, thus resulting in a highly significant increase in revenue-producing cargo capacity, in comparison with similar cars using conventional unreinforced thicker-walled box beam construction.

Although the best mode contemplated for carrying out the present invention has been herein shown and described, it will be apparent that modification and variation may be made without departing from what is regarded to be the subject matter of the invention, and the scope of the invention is defined and limited only by the claims which follow.

What is claimed is:

1. An improved side sill for an improved body for a lightweight railway car having side sills connected to body bolsters pivotably supported on trucks and adapted to support at least one container, each container having a plurality of lower corners projecting downwardly between the side sills, wherein the improvements in said side sill comprise:

(a) a generally vertically aligned, longitudinally oriented first metal plate;

(b) a first channel member fixedly interconnected with said first plate and extending therealong substantially parallel therewith, said first channel member in combination with said first plate defining a box beam having a height and a width which is smaller than said height; and (c) means for providing strength in said side sill to resist local buckling of said first plate and said first channel member, said means including a plurality of stiffening tubes extending from said first plate to said channel, each of said tubes extending generally transversely of said side sill and having a first end welded to said first plate and a second end welded to said first channel member, and said first channel member defining a plurality of openings therein each communicating with the interior of a respective one of said tubes, each tube having a length and a largest dimension, perpendicular to said length, said largest dimension being at least twice said length.

2. A side sill according to claim 1 wherein the area of said openings defined in said first channel member is substantially equal to the exterior wall area of said tubes.

3. A side sill according to claim 1 wherein said first plate, said tubes, and said first channel are formed from steel which is no more than about ¼ inch thick.

4. The side sill according to claim 1 wherein said openings in said first channel member are generally circular, and wherein said tubes are substantially cylindrical tubes.

5. An improved body for a lightweight railway car having side sills connected to body bolsters pivotally supported on trucks, and adapted to support at least one container, each container having a plurality of lower corners projecting downwardly between the side sills, comprising:

(a) a generally vertically aligned, longitudinally oriented first metal plate;

(b) a first channel member fixedly interconnected with said first plate and extending therealong substantially parallel therewith, and in combination with said first plate defining a box beam having a height and a width which is smaller than said height;

(c) means for providing strength in said side sill to resist local buckling of said first plate and said first channel member substantially without increasing the weight of said side sill, said means including a plurality of stiffening tubes extending generally transversely of said side sill from said first plate to said channel, each of said tubes having a first end welded to said first plate and a second end welded to said first channel member, and said first channel member defining a plurality of openings therein each communicating with the interior of a respective one of said tubes and being substantially similar in size and shape with the interior of the respective tube, each tube having a length and a largest dimension perpendicular to its length, said largest dimension being at least said length;

(d) lower portions included in said side sills; and (e) a plurality of container-supporting feet secured to said lower portions of said side sills and adapted to engage and support a container by engaging four lower corners thereof, with a lower surface of the container being at a level substantially even with said lower portions of said side sills.

6. An apparatus according to claim 5 wherein said container is a 40-foot container.

7. An apparatus according to claim 5 wherein said feet are located so as to engage and support two containers aligned end-to-end between said side sills.

8. An apparatus according to claim 5 wherein said lower portions of said side sills are interconnected with each other by means including transverse beams and cross beams for minimizing deflection of each of said side sills relative to the other.

9. An apparatus according to claim 5 wherein each of said container-supporting feet has a container-supporting surface and said lower portions are interconnected with each other by a plurality of transverse beams and a plurality of cross beams located at a level below said container-supporting surface.

10. An improved body for a lightweight railway car, having side sills connected to body bolsters pivotally supported on trucks, and adapted to support at least one container, each container having a plurality of lower corners projecting downwardly between the side sills, the body comprising:

(a) a generally vertically aligned longitudinally oriented first metal plate;

(b) a first channel member fixedly interconnected with said first plate and extending therealong substantially parallel therewith, and in combination with said first plate defining a box beam having a height height and a width which is smaller than said height;

(c) means for providing strength in said side sill to resist local buckling of said first plate and said first channel member substantially without increasing the weight of said side sill, said means including a plurality of stiffening tubes extending generally transversely of said side sill from said first plate to said channel, each of said tubes having a first end welded to said first plate and a second end welded to said first channel member, and said first channel member defining a plurality of openings therein each communicating with the interior of a respective one of said tubes and being substantially similar in size and shape with the interior of the respective tube, each tube having a length and a largest dimension perpendicular to its length, said largest dimension being at least equal to said length;

(d) lower portions included in said side sills; and (e) a plurality of container-supporting feet secured to said lower portions of said side sills and adapted to engage and support a container by engaging four lower corners thereof, with a lower surface of the container being at a level substantially even with said lower portions of said side sills, said lower portions thereof including a plurality of second channel members located beneath and welded to said first plate and said first channel at locations spaced apart therealong, and said transverse beams, cross beams, and container-supporting feet being fixedly attached to respective ones of said second channel members.

11. An improved body for a lightweight railway car having side sills connected to body bolsters pivotally supported on trucks and adapted to support at least one container having a lower portion projecting downwardly between the side sills and body bolsters, the improvement in each side sill and body bolster comprising:

an outer plate of each side sill being of thin metal;

a plurality of spaced tubes welded to said outer plate and projecting inwardly therefrom;

means defining a channel having a plurality of portions removed therefrom defining openings therein spaced a distance apart equal to the spacing of said tubes, said tubes being welded thereto adjacent the periphery of said openings, said portions removed from said channel having a weight equal to at least $\frac{3}{4}$ of the weight of said tubes, for reducing the weight of said railway car and for improving the anti-buckling strength of said side sills;

each body bolster including a stub-center sill;

a pair of floor plates welded to said stub-center sill and projecting laterally outwardly in opposite directions therefrom;

a pair of upright side walls welded to the ends of said floor plates;

a plurality of spaced upstanding baffles welded to said floor plates and each having a large weight reducing opening therein;

first and second upstanding walls and a top wall welded to one another and to said end walls, said end walls, said baffles and said floor plates providing a rigid, lightweight box body bolster;

a pair of angle brackets welded between the stub-center sill and the associated bottom plate to minimize bending of the bolster relative to its stub-center sill; and means for rigidly connecting associated ends of said side sills to associated ends of said bolsters.

12. An apparatus according to claim 11 wherein the area of said removed portions of said channel is at least equal to $\frac{3}{4}$ of the interior wall area of said tubes.

13. In an improved body for a lightweight railway car adapted to support at least one container and having vertically deep side sills connected to body bolsters pivotally supported on trucks, an improved side sill comprising:

a transversely outer longitudinally extending thin metal wall having upper and lower surfaces;

a transversely inner longitudinally extending thin metal wall having upper and lower surfaces; and a plurality of stiffening tubes spaced longitudinally of said side sill and transversely disposed between and rigidly secured to said inner and outer side walls for improving the anti-buckling strength of said side sill, each of said stiffening tubes having a length and a greatest dimension perpendicular to said length, said greatest dimension being greater than said length.

14. An apparatus according to claim 13 and additionally comprising first transversely disposed structural means for rigidly connecting said upper surfaces together, and second transversely disposed structural means for connecting said lower surfaces together.

15. An apparatus according to claim 14 wherein said first and second structural means are respective upper and lower portions of at least one of said thin metal walls, each of said upper and lower portions being bent toward and rigidly secured to the other of said walls.

16. An apparatus according to claim 13 wherein at least one of said walls has a plurality of portions removed therefrom defining openings therein for reducing the weight of said side sill, said openings being spaced apart a distance equal to the spacing of said tubes and having said tubes rigidly secured to said walls adjacent the peripheries of said openings.

17. An improved body for a lightweight railway car for carrying an intermodel container, comprising:

(a) a pair of longitudinally extending laterally narrow and vertically deep side sills, each including a laterally outer upstanding longitudinally extending thin metal wall having upper and lower margins, a laterally inner upstanding longitudinally extending thin metal wall spaced apart transversely of said car from said outer thin metal wall and having upper and lower margins, and a plurality of metal stiffening tubes spaced apart longitudinally of said side sill and transversely disposed between and rigidly secured to both of said laterally outer and inner thin metal walls for improving the anti-buckling strength of said side sill, each of said stiffening tubes having a length and a diameter, the diameter being at least equal to said length; and (b) transversely extending container support means supported by said side sills and interconnecting said side sills for suporting at least one container located at least partially between said side sills.

18. The railway car of claim 17 wherein each of said stiffening tubes has a length and a diameter, the diameter being at least twice the length.

19. The railway car body of claim 17 wherein each of said side sills comprises first transversely disposed structural means for rigidly interconnecting the upper margins of said inner and outer thin metal walls and second transversely disposed structural means for interconnecting the lower margins of said inner and outer thin metal walls.

20. The railway car body of claim 19 wherein at least one of said thin metal walls defines an opening extending therethrough and located in alignment with the interior of one of said stiffening tubes.

21. The railway car body of claim 20 wherein each said opening is of substantially the same size as a respective one of said stiffening tubes.

22. The railway car body of claim 19 wherein said first and second structural means are respective upper and lower portions of the material of at least one of said thin metal walls, each of said upper and lower portions being bent toward and rigidly secured to the other of said walls.

23. The railway car body of claim 17 wherein at least one of said inner and outer thin metal walls has a plurality of portions removed therefrom defining openings therein for reducing the weight of a respective one of said side sills, said openings being spaced apart a distance equal to the spacing of said stiffening tubes and having said stiffening tubes rigidly secured to said thin metal walls adjacent the peripheries of respective ones of said openings.

* * * * *

UNITED STATES PATENT AND TRADEMARK OFFICE

CERTIFICATE OF CORRECTION

PATENT NO. : 4,703,699

DATED : November 3, 1987

INVENTOR(S) : Charles C. Hill

It is certified that error appears in the above-identified patent and that said Letters Patent is hereby corrected as shown below:

| | | | |
|---|---|---|---|
| Col. 2, | Line 41 | Change "3-13" to --3-3--; | |
| | Line 54 | Change "v-shaped" to --V-shaped--. | |
| Col. 3, | Line 59 | Change "preferabIy" to --preferably--. | |
| Col. 4, | Line 44 | Change "load-hearing" to --load-bearing--; | |
| | Line 45 | Change "ridigity" to --rigidity--. | |
| Col. 7, | Line 60 | Delete "height"., second occurrence. | |
| Col. 10, | Line 9 | Change "suporting" to --supporting--. | |

Signed and Sealed this

Twenty-first Day of June, 1988

*Attest:*

DONALD J. QUIGG

*Attesting Officer*

*Commissioner of Patents and Trademarks*